United States Patent [19]

Rudwick et al.

[11] 4,360,213

[45] Nov. 23, 1982

[54] SPORT TYPE WHEEL CHAIR

[76] Inventors: Lawrence A. Rudwick, 3200 Glenwood Pl., Falls Church, Va. 22041; Steven A. Schuman, 6038 Westchester Park Dr., College Park, Md. 20740

[21] Appl. No.: 136,576

[22] Filed: Apr. 1, 1980

[51] Int. Cl.[3] ..... A61G 5/02

[52] U.S. Cl. ..... 280/242 WC; 16/35 D; 297/DIG. 4; 301/37 P; 301/114; 403/313; 403/314

[58] Field of Search ..... 280/242 WC, 647, 39, 280/289 R, 289 D; 297/DIG. 4, 440, 441; 403/314, 313, 309, 312, 306; 301/114, 119, 37 C, 37 CD, 37 P; 16/35 D

[56] References Cited

U.S. PATENT DOCUMENTS

| | | | |
|---|---|---|---|
| 2,387,436 | 10/1945 | Frank | 403/314 |
| 2,507,421 | 5/1950 | Rose | 296/205 X |
| 2,713,891 | 7/1955 | Linquist | 297/DIG. 4 |
| 2,782,835 | 2/1957 | Liebach | 297/DIG. 4 |
| 3,355,219 | 11/1967 | Brumfield | 301/37 CD |
| 3,873,162 | 3/1975 | Segawa | 301/114 X |
| 3,924,292 | 12/1975 | Chistensen | 16/35 D |
| 3,937,490 | 2/1976 | Mohamed | 280/242 WC |
| 4,166,631 | 4/1979 | Sanski | 280/242 WC |

FOREIGN PATENT DOCUMENTS

| | | | |
|---|---|---|---|
| 376251 | 7/1932 | United Kingdom | 297/440 |

*Primary Examiner*—John A. Pekar
*Attorney, Agent, or Firm*—Howard L. Rose

[57] ABSTRACT

A sports wheel chair has elongated side frame members of hollow high strength tubing extending along the two sides of the chair to provide rear wheel and seat support and extending accurately downwardly to provide front wheel supports. The elongation provides a degree of flexibility that permits front end collisions without damage and permits flexure to maintain contact of all four wheels with uneven terrain. Elongation of the frame increases stability and concentrates weight on the rear wheels for greater maneuverability. The main wheels are cambered out from top to bottom to protect the hands and provide a wider wheel base. All of the frame members are hollow tubes to impart light weight to the chair along with great strength. The two elongated side frame members are joined by novel strong quick connecting and disconnecting parts at the front and back to permit rapid disassembly without sacrificing strength. The front connecting part also provides a foot rest. The main wheels are secured to the frame by strong quick disconnect mechanisms for quick removal and replacement and a removable spoke shield is provided which is retained primarily by the hand wheel connectors. A canvas seat and back having Velcro connections provides ready removal and the ability to change seat angle and position of the seat and backrest.

14 Claims, 18 Drawing Figures

FIG. 4
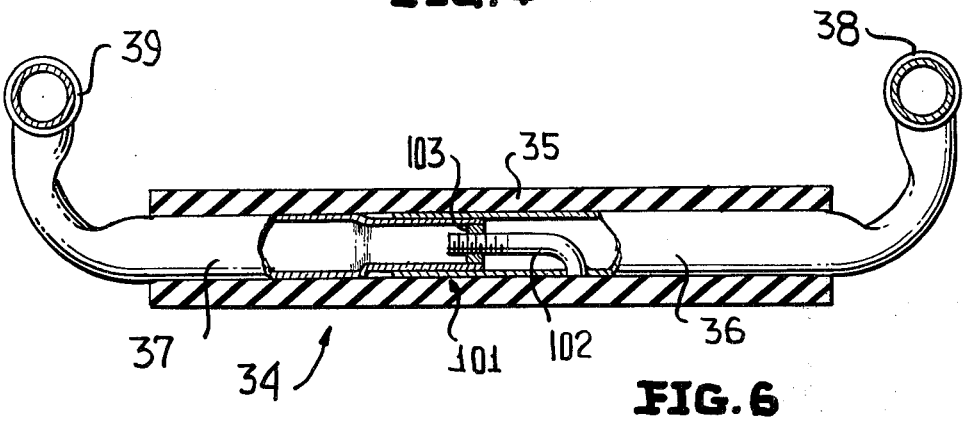
FIG. 6
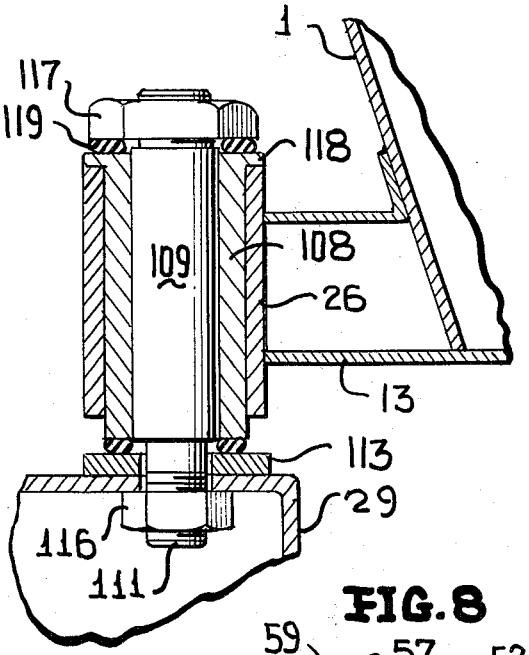
FIG. 5
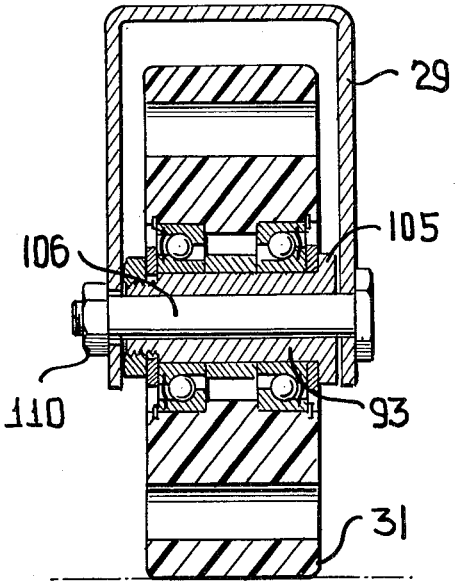
FIG. 8
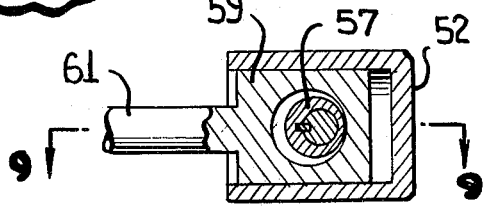
FIG. 7
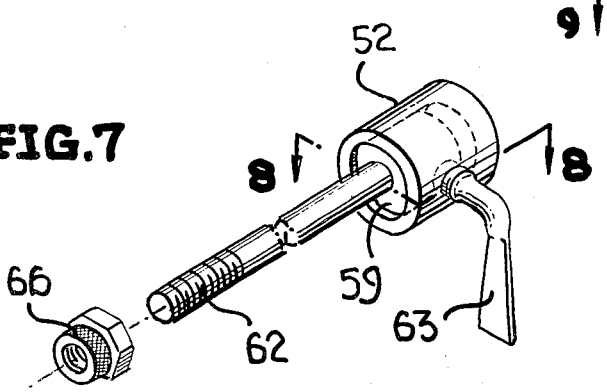
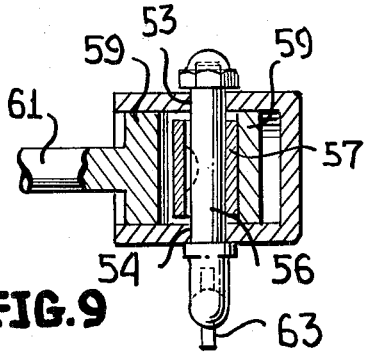
FIG. 9

FIG. 10
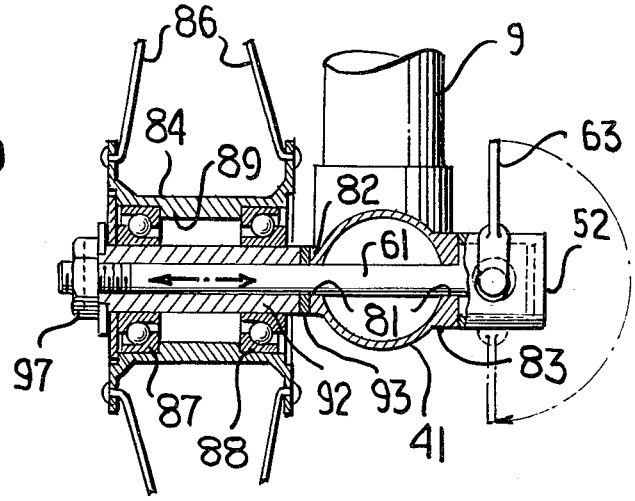
FIG. 11
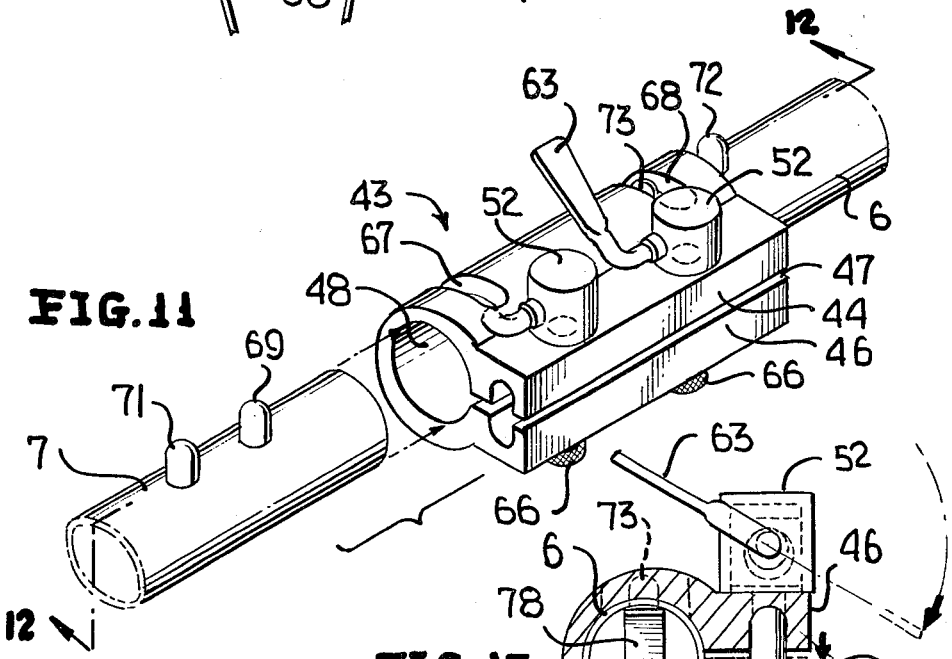
FIG. 13
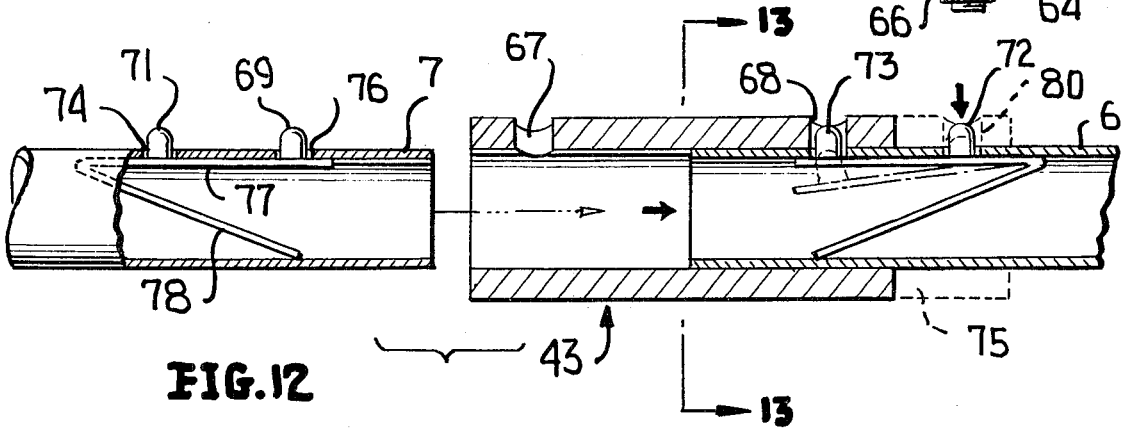
FIG. 12

FIG. 16
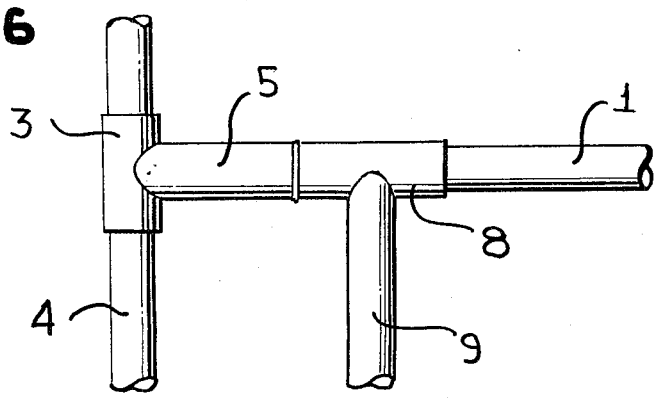
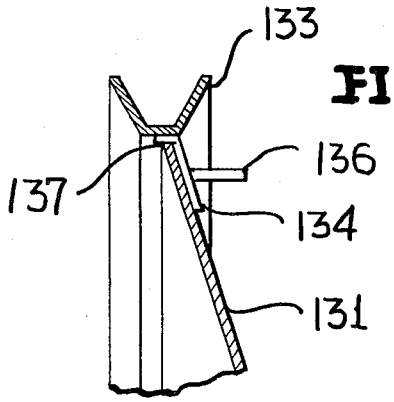
FIG. 18
FIG. 17
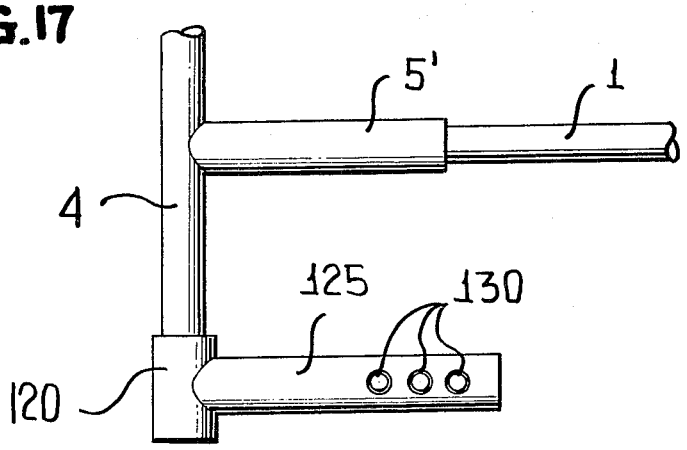

SPORT TYPE WHEEL CHAIR

RELATED DISCLOSURE

The applicants have filed Invention Disclosure Certificate No. 080,065 on Apr. 13, 1969.

TECHNICAL FIELD

The present invention relates to wheel chairs and more particularly to sports type wheel chairs and to the solution of the specific problems encountered in such devices.

BACKGROUND OF THE INVENTION

The present wheel chair used in sports such as basketball and racing are merely adaptations of existing hospital type wheel chairs and as such are not truly adequate to the tasks for which such wheel chairs are to be employed. The frames are not sufficiently strong to run into a wall at five to six miles an hour which is common in wheel chair basketball, are not sufficiently light weight to permit fast maneuvering or acceleration for both basketball and racing and do not lend themselves to quick replacement of damaged parts and do not provide in a collapsible wheel chair the strength or lightness required in a sports type wheel chair. There are collapsible wheel chairs, but they do not provide lateral stability or strength as is required in a wheel chair that, particularly in basketball, may be hit hard from the side. Also, the hospital chairs do not protect the wheels or the spokes of the wheels or permit rapid replacement of damaged parts which are important requisites in particular in a basketball type wheel chair. Further, the existing wheel chairs do not permit the operator to change seat position readily which may be desirable for different uses of the chair particularly if the operator is to employ the chair for sports and non-sport applications.

It is an object of the present invention to provide a rugged, light weight and quickly disassemblable and assemblable wheel chair for use in various sports events.

It is another object of the present invention to provide a sports type wheel chair which may be quickly disassembled to provide two frame halves each half comprising a main wheel and a front or guide wheel.

It is another object of the present invention to provide a wheel chair with forwardly extending side members considerably elongated to provide flexibility in the presence of front end impact to thereby lessen the danger of damage to both the operator and the wheel chair and to provide flexibility to permit four point contact in the presence of uneven terrain and absorb impact from proceeding over bumps.

Yet another object of the present invention is to provide an elongated frame for wheel chairs to concentrate weight on the rear wheels to increase maneuverability of the chair and decrease the incidence of forward tipping of the chair.

Still another object of the present invention is to provide a wheel chair having cambered rear wheels to increase the wheel base and protect the operators hands.

It is another object of the present invention to provide an adjustable width wheel chair.

An object of the present invention is to provide a combined floor protector and anti-tip device mounted below the foot plate of the chair.

It is still another object of the present invention to provide seats and backs which permit change of the pitch, depth and width of the seat and taughtness, angle and width of the back of the seat.

SUMMARY OF THE INVENTION

In accordance with the present invention, there is provided a sports type wheel chair having all the essential features for such use which are not found in the conventional hospital or collapsible hospital type wheel chairs. The wheel chair of the present invention provides the ability to rapidly disassemble the chair to permit storage or loading into an automobile without sacrificing any of the lateral stability or strength necessary to withstand the strains of rapid maneuvering, side impacts and front and rear end impacts, but particularly front end impacts.

The frame of the structure is fabricated totally from hollow tubing with side members which support the seat and extend forward to support the front wheels. The side members are elongated hollow tubes of very strong steel which extend from the seat area in a downward curve to provide a degree of flexibility necessary to permit the wheel chair to be run into a wall or other chair or other structure at up to five to six miles an hour without damaging the chair or, more particularly, the side frame members or the rider. The flexibility of the elongated members serves also to permit independent movement of the front wheels to adapt to uneven terrain and concurrent flexure to absorb impact due to bumps; serving in this capacity as a spring-like suspension. The elongation of the chassis, 4 to 5 inches, for instance, greater than in normal chairs, concentrates the weight of the rider on the rear wheels facilitating maneuvering of the chair and rapid starts and stops. The latter feature results from increased friction of the rear wheels due to the added weight. Additionally, the elongated body reduces forward tipping of the chair.

The body is formed in two parts which are mirror images of one another with a left side and a right side each having an inwardly directed hollow tube located rearwardly of the axle of the rear wheel; the inwardly directed tubes being clamped together, rigidly if desired, by a quick disconnect device so that they may be rapidly and easily disconnected. The two halves may be permitted some independent rotation relative to one another to permit accommodation to rough terrain.

The forward ends of the side members are connected together by a rigid foot plate that provides front end lateral stability and strength to the forwardly extending wheel and foot rest supports. The plate may be rapidly and easily removed whereby upon removal of the foot plate and the quick disconnect connector between the two inwardly extending hollow tubular members, the device falls immediately into two distinct halves which are readily and easily loaded. The foot plate mount also permits a limited degree of rotation of the two frame halves relative to each other.

The rear wheels are secured to the two frame halves by quick disconnect mechanisms permitting the wheels to be quickly replaced. Specifically, rotation of a cam member releases the tension on a nut on the axle, whereby the nut may be quickly backed off and the wheel removed and quickly replaced. Upon replacement, the nut is merely finger tightened onto the shaft holding the new wheel and then the cam turned to provide the requisite tightening and holding action. The wheels are cambered out from top to bottom to provide a wide wheel base and protection for the hands of the operators.

The seat and back rest are of canvas fabric held together by extensive areas of Velcro. Because of the use of the Velcro, the seat in particular may be adjusted to provide a backward tilt or forward tilt or a generally flat platform depending on the use for which the device is to be employed. Also, of course, the use of the Velcro permits both the seat and the back to be quickly removed in keeping with one of the primary purposes of the invention which is quick assembly and disassembly of the wheel chair for portability and repair purposes. Further, the use of extensive areas of Velcro permits the amount of overlap of the end flaps of the seat and back to be varied and thus control the height of the seat and the position of the back of the seat and therefore the position of the operator over the wheels.

Another important feature of the invention is the utilization of a design permitting the use of epoxy cements to hold the various tubular structures together so as to reduce costs relating to welding or in some instances to silver brazing. This latter material is very expensive in view of the price of silver, and its replacement by cheap epoxy is an important feature of the economy of the chair of the invention. Additional features of the invention relate to anti-flutter device for the front wheels of the wheel chair, the ability to mount the main wheels in two different or multiple locations, the provision of a rigid floor protector or anti-tip device and rapid replacement of the front wheels.

BRIEF DESCRIPTION OF THE DRAWINGS

The above and still further objects, features and advantages of the present invention will become apparent upon consideration of the following detailed description of one specific embodiment thereof, especially when taken in conjunction with the accompanying drawing, wherein:

FIG. 4 illustrates a modified front anti-tip roller or floor protector of the apparatus, partially in section.

FIG. 5 is a view partially in section of a front wheel support of the present invention.

FIG. 6 is a sectional view taken along line 6—6 of FIG. 3 illustrating the vertical hub arrangement for supporting the front wheel yoke of the present invention.

FIG. 7 is an exploded view of the quick disconnect feature utilized in various parts of the apparatus of the invention.

FIG. 8 is a sectional view taken along line 8—8 of FIG. 7.

FIG. 9 is a sectional view taken along line 9—9 of FIG. 8.

FIG. 10 is a view partially in section of the application of the quick disconnect apparatus of FIG. 7 applied to one of the large wheels of the wheel chair and illustrating the novel hub arrangement utilized in connection with the quick disconnect mechanism.

FIG. 11 is a view in perspective of the quick disconnect mechanism employed to assemble the two half sections of the wheel chair illustrated in FIG. 3.

FIG. 12 is a sectional view taken along line 12—12 of FIG. 11 illustrating the button mechanism used in various places in the apparatus of the invention.

FIG. 13 is a sectional view taken along line 13—13 of FIG. 12.

FIG. 16 illustrates a change in the wheel and back support arrangement to permit the use of epoxy to secure the support for the main or large wheels to the frame.

FIG. 17 illustrates an alternative wheel mount arrangement, and

FIG. 18 illustrates details of the rim support for a spoke shield provided in accordance with the invention.

DESCRIPTION OF THE PREFERRED EMBODIMENTS

Figure 1:
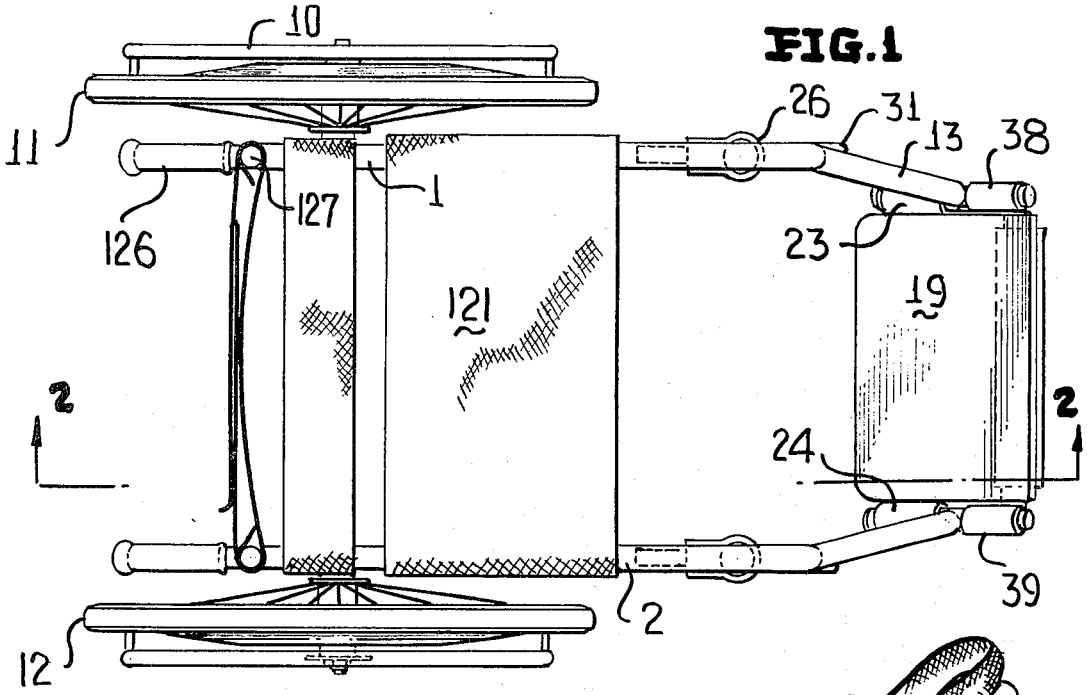
FIG. 1 is a top plan view of one embodiment of the apparatus of the present invention.
Figure 2:
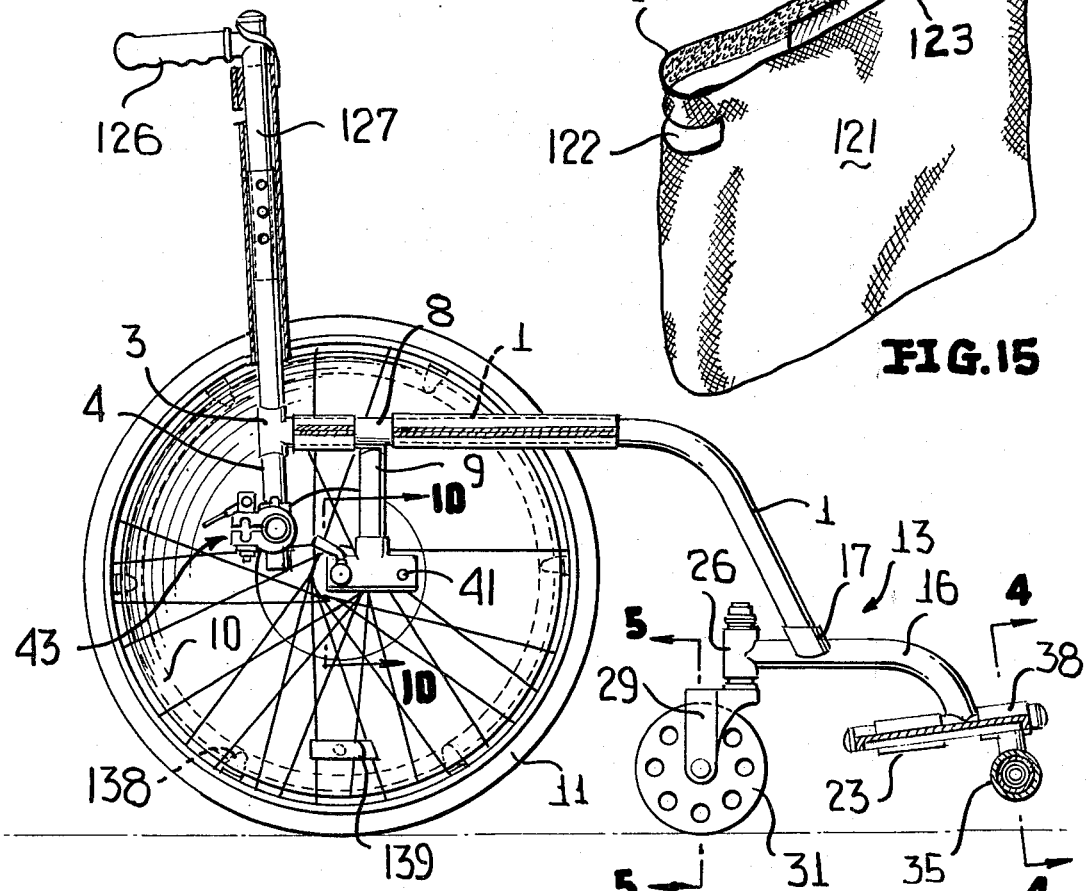
FIG. 2 is a section in elevation taken along line 2—2 of FIG. 1.
Figures 3, 14:
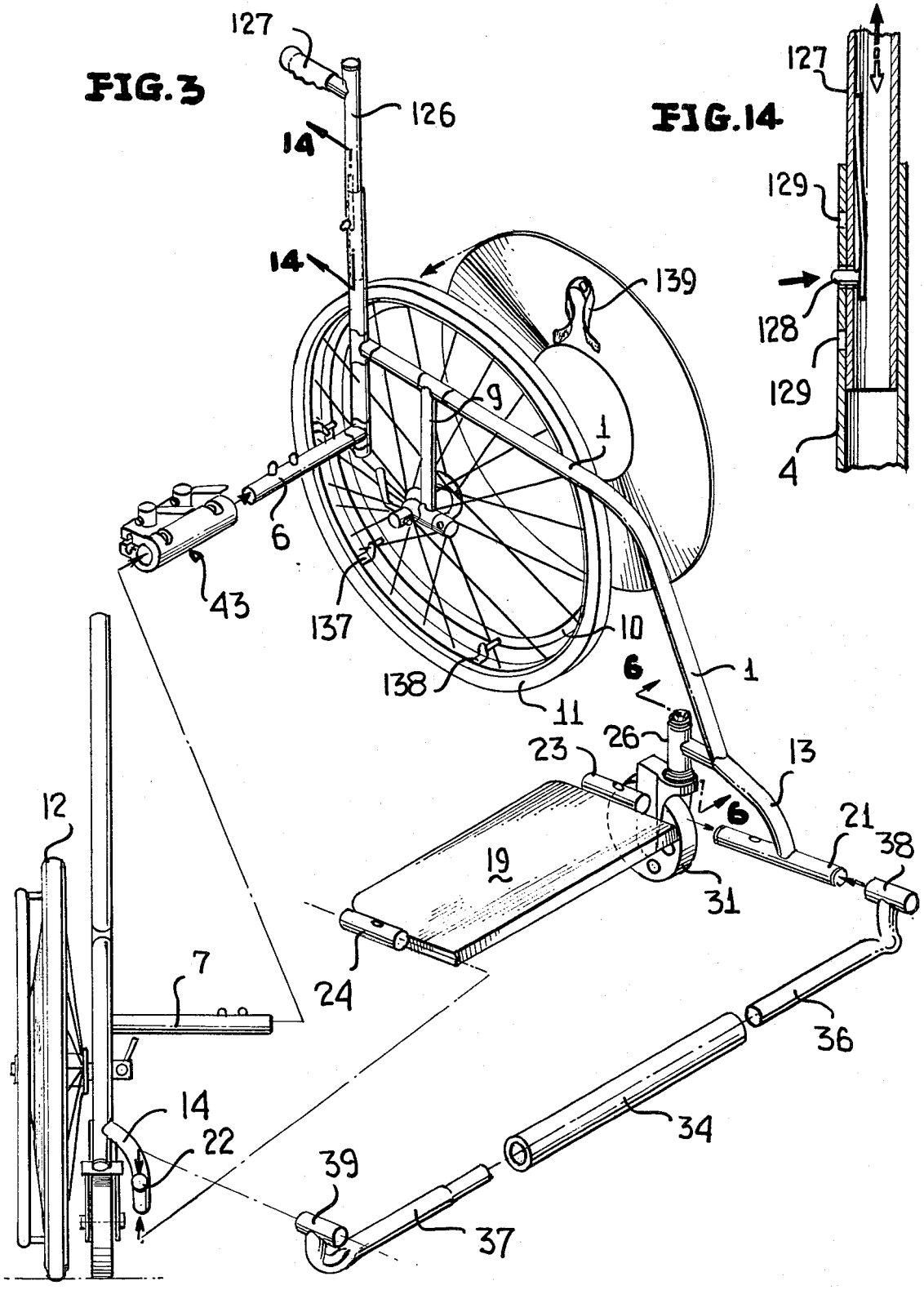
FIG. 3 is an exploded view of the disassembled apparatus of FIGS. 1 and 2 illustrating various parts of the structure in different planes.
FIG. 14 is a sectional view taken along line 14—14 of FIG. 3 and illustrating the mechanism for adjusting the height of the push handles on the wheel chair of the present invention.

Referring specifically to FIGS. 1, 2 and 3, the basic design of the wheel chair of the present invention comprises two forwardly extending and downwardly depending side frame members 1 and 2, of substantially identical configuration. These members are hollow tubes of high strength steel. The member 1 has connected at its rearward end a hollow T-shaped connector 3 with leg 5 of the "T" secured to the end of the rear end of member 1 and having extending vertically therethrough the hollow cross arm of the "T" a vertical hollow tube 4. At the lower end of the tube 4 as viewed in FIGS. 2 and 3 is a horizontally extending hollow tube 6 perpendicular to both of the tubes 1 and 4 extending inwardly toward the frame member 2 by a distance equal to about half of the width of the chair.

There is associated with the member 2, a corresponding inwardly extending member or hollow tube 7 which when coupled to the tube 6 by a mechanism to be described, the main frame members 1 and 2 may be rigidly joined to provide a strong rear cross coupling between the two frame members. The frame member 1 has secured thereto forward of the T-shaped conductor 3, a second T-shaped hollow member 8 with a generally vertical downwardly elongated leg 9 adapted to support a main rear wheel 11. Correspondingly, a main rear wheel 12 is supported on the frame member 2. The hollow tube 9 may extend vertically downward but preferably the member 9 is rotated 3° to 4° outward so that the lower end of tube 9 is rotated toward its associated wheel whereby the rear wheels are cambered with its bottom edge further from the chair body than its top edge. The camber permits a more normal arm movement by the operator when pushing on hand wheels such as hand wheels 10 and 15 since normal downward pushing when sitting has a side thrust component. Further, the broadened wheel base prevents other chairs of like design from approaching sufficiently close to crush the operator's hands.

The frame members 1 and 2 generally extend horizontally for a short distance rearward of and a greater distance forward of the wheels 11 and 12 and then depend downwardly at about a 60° angle terminating just above wheel support members 13 and 14 respectively. Each wheel support member has a generally horizontal section 16 angled inwardly from back to front. The horizontal section carries an upward hollow stub shaft 17 into which the end of the member 1 telescopes and is secured thereto generally with epoxy cement. The horizontal portion 16 terminates in a downwardly extending member 18 to which is secured a support for a foot plate 19. The support for the foot plate 19 is a hollow tubular member 21 angled slightly upward from back to front. The member 14 associated with the frame member 2 has a corresponding hollow tube 22 associated therewith.

The foot plate 19 carries at the opposite sides thereof two hollow generally tubular members 23 and 24 of a diameter to receive therein the rear part of the tubes 21 and 22, respectively, subsisting behind the connection between the members 13 and the tube 21. When the foot plate, which is made of strong metal, is secured to the two hollow tubes 21 and 22, the front of the two halves of the frame are rigidly secured together. The inward angling of the members 13 and 14 and the use of a relatively shallow foot plate permit the front wheels of the chair to be located further forward on their supports than is the case with chairs of more conventional construction. The forward location of the wheels, as previously indicated, increases maneuverability and stability of the chair.

The horizontal member 16 and its counterpart 14 associated with frame member 2 extend rearwardly of the members 1 and 2 and have secured to the rear ends thereof generally vertical hollow hubs 26 and 27 in which are supported shafts only one of which is illustrated and that being the one associated with the frame member 1 and carrying the reference numeral 28. Secured to the lower end of the shaft 28 is a wheel yoke 29 between the fingers of which are supported a front wheel 31 of the apparatus. A similarly supported yoke 32 relative to frame member 2 is employed to support a small wheel 33 of the wheel chair.

Also supported by the members 21 and 22 is a front anti-tip roller 34 carried on hollow tubular cross members 36 and 37 having formed on the ends thereof hollow cylindrical members 38 and 39 which slip over the front ends of the hollow members 21 and 22. The members 36 and 37 may telescope inside the roller 34 or if more rigidity is desired, they may be screwed together by means to be discussed subsequently.

Referring now to the details of the support for the main wheels 11 and 12, the hollow vertical downwardly depending tube 9 has welded or epoxied to the bottom thereof a hollow tube 41 having two holes drilled therein such as the exposed hole 42 as viewed in FIG. 2 and a hole which is actually being used to secure the wheel 11 thereto and which therefore cannot be illustrated but only discussed. The shaft which supports the wheel can be placed through either of these two apertures so as to move the wheel forward or backward as desired by the operator.

Referring now to the last member necessary to assemble the device, the hollow tubes 6 and 7 are secured together by a clamp 43 which is basically, as viewed in FIGS. 11, 12 and 13, a cylindrical split ring having forwardly extending portions 44 and 46 separated by a slot 47. Split ring 43 has a cylindrical aperture 48 extending horizontally therethrough to receive cooperating tubes 6 and 7. The forward extensions of the split ring assembly 43 as indicated are spaced apart by the slot 47 and when the hollow tubes 6 and 7 are disposed therein, the members 46 and 44 may be drawn toward one another to rigidly clamp the hollow tubes. The mechanisms, there are two illustrated in FIG. 11 bearing the reference numerals 49 and 51, are illustrated in greater detail in FIGS. 7, 8 and 9. These members, referring to the latter figures, comprise a hollow cylindrical closed end cap 52 having coaxial transverse apertures 53 and 54 for receiving a shaft 56 therein. Shaft 56 carries an eccentric part 57 received in a bore 58 in head 59 of a bolt 61 having a threaded part 62 at the end of the bolt remote from the head end 59. Rotation of the shaft 56 by means of a right angled handle 63, causes the head 59 of the bolt 61 to translate left and right as viewed in FIGS. 8 and 9 within the end cap 52.

In use, the bolt 62 is extended through an aperture 64 extending through the members 44 and 46 and a nut 66 is threaded on the end of the bolt 61 with the head 59 translated toward the members 64, 66 to the maximum extent possible. After the nut 66 is made finger tight against the bottom of the member 46 as viewed in FIG. 13, the handle 63 is rotated to translate the head 59 of the bolt to the right as viewed in FIGS. 8 and 9 and therefore compress the members 44 and 46 towards one another to grip for instance, the tube 7; the operation relating to the member 49 and its associated parts being identical and serving to grasp the tube 6. The tubes 6 and 7 may be made to telescope with the outer member split so that only a single member 49, for instance, would be required.

It will be noted that the main body 43 of the clamp is provided with two slotted apertures 67 and 68 along the top of the cylindrical part of the body 43 and adjacent against the opposite ends thereof. The slots 67 and 68 are adapted to receive button 69 for the slot 67 and button 73 associated with the tube 6. These buttons are seated in apertures in the tubes and the tube 7 only is discussed. Buttons 69 and 71 are carried on a flat plate 77 forming together with a downwardly angled portion 78 thereof a spring mechanism. The buttons 69 and 71 extend out of apertures 74 and 76 in the wall of the hollow tube and the button 72 may be depressed so as to cause button 73 to recede below the surface of the tube and permit tube 6 to be withdrawn from member 43. The buttons 69, 71, 72, 73 are utilized to initially and quickly position the tubes 6 and 7 within the member 43 and hold them there.

The buttons are sufficient to retain the tubes 6 and 7 within the members 43 except in the roughest of uses in which event members 49 and 51 are tightened to rigidly clamp the tubes. Otherwise the members are not clamped and this together with the slotted apertures 67 and 68 permit limited rotation of the tubes 6 and 7 relative to one another about their axes. This effect in conjunction with the tubular mounts for the foot plate 19 and the roller 34 permit such limited rotation at all connections between the frame members. This feature is particularly important in racing chairs where accommodation to uneven terrain is highly desirable feature.

The use of the two buttons on each tube permits two different positions for the shafts in conjunction with a modified member 43 so as to accommodate different widths of the chair at the back. Different width foot plates 19 and rollers 34 may be provided. The difference in width may be about 2 inches if the alternative arrangement of FIG. 12 is employed. At the right end of the member 43 as illustrated in FIG. 12 is a dashed line section generally designated by reference numeral 75. This section has an additional slot 80 formed therein which when the chair is made narrow, receives button 72 but when the chair is widened receives button 73. If the member 43 is elongated to the right as viewed in FIG. 12, it will normally also be extended to the left.

It should be noted that the button mechanism illustrated in FIG. 12 is employed in many places throughout the wheel chair of the present invention and is utilized with respect to the foot plate 19 wherein buttons associated with the member 21 fit in holes or apertures such as 79 in the two side members of the foot plate. Similarly as is indicated later, the height of the handles on the wheel chair are controlled by such spring biased buttons. On the other hand, the eccentric type arrangement associated with the member 43 is utilized for quick connect and disconnect if desired of the wheels 11 and 12.

Referring now specifically to FIG. 10, the wheel mounting mechanism and the quick connect and disconnect feature thereof are discussed. The tube 41 has a transverse horizontally extending aperture 81 formed therein which extends through the opposed thin walls of the member 41 perpendicular to the member 9. Ears 82 and 83 extend outwardly from the member 41 surrounding the aperture 81 to provide flat faces parallel to the axis of tube 9 for purposes which become apparent subsequently.

The wheel 11, for instance, carries a hub 84 to which are secured spokes 86 of the wheel in completely conventional manner. The hub is a hollow cylindrical member having ball bearings 87 and 88 disposed at opposite ends as viewed in FIG. 10 of the bore of the hub and held apart by an inwardly extending shoulder 89 of the hub 84. A hollow shaft or bushing 92 extends outwardly from both ends of the hub and is force fitted within the ball bearings 87 and 88. The right extension of the bushing 92 where the wheel is mounted is clamped against a washer 93 which in turn is seated against ear 82 of the tube 41.

A bolt 61 of a quick release mechanism such as illustrated in FIG. 11, extends through the aperture 81 in the hollow tubular member 41, through the hollow sleeve 92 and is secured by a nut 97. The outer shell 52 of the quick release mechanism seats against the ear 83 which extends outwardly from the member 41.

To mount the wheel, the eccentric is positioned so that the head 59 of the molt is moved toward the member 41 as close as possible and the shaft 61 is extended through the aperture 81 and through the hollow sleeve 92 and the nut 97 is applied finger tight. The crank 63 is then rotated to draw the hub tightly against the ear 82 and secure the wheel tightly to the frame. The procedure is reversed if it is wished to take the wheel off which can be done very quickly as is believed to be apparent from the above description.

Referring now specifically to FIG. 4 of the accompanying drawings, the front floor protector or anti-tip device 34 is illustrated in detail. The device constitutes an outer sleeve 35 which may be of plastic and as previously indicated, two tubular members 36 and 37. The members 36 and 37 preferably telescope as indicated by reference numeral 101 and in many instances that is all that is required. If a stronger connection is required, a bolt 102 is secured internally in one of the tubes for instance the tube 36 and a nut 103 is secured within the other tube adjacent its end for instance tube 37. To assemble, the sleeve 35 is applied to one of the tubes, the tubes are slipped together and then rotated relative to one another such as to cause the bolt 102 to thread into the nut 103 until the telescoping portions of the tubes overlap to the degree necessary to accommodate the width between members 21 and 22.

Referring now specifically to FIG. 5, an arrangement for the front wheels 32 and 33 is illustrated. It will be noted that the hub arrangement generally designated by reference numeral 104 is similar to that utilized with respect to the rear wheel hub as illustrated in FIG. 10. The only difference between the two arrangements is that a flange 105 is provided in bushing 92 and a nut 96 is secured to threads formed on the other end of bushing 92. The assembly is located within the fingers of the yoke 29 while a bolt 106 replaces the quick release mechanism of FIG. 10 with the head of the bolt 106 and a nut 110 located externally of the side members of the yoke 29. Again, this arrangement, because of the independent mounting of the wheel on a sleeve, provides for quick replacement of the wheels although in this instance, the eccentric is not utilized.

It is often found that the front wheels of a device such as a wheel chair flutter badly when the chair is moved rapidly. In order to overcome this problem, the apparatus arrangement of FIG. 6 has been provided. The hub 26 is secured to the hollow tube 13. Located within the member 26 is a hollow sleeve bearing 108 serving as a sleeve bearing for a shaft 109 having a lower threaded end portion 111 and upper threaded end portion 112. A washer 113 is disposed about the shaft 109 about the threaded end portion 111 of shaft 109 in contact with the top of the yoke member 29. Disposed between the washers 113 and the end of the sleeve bearing 108 is an O-ring 114 which is depressed upon nuts 116 and 117 being applied to the two ends of the shaft 109. At the upper end of the shaft 109 there is disposed an O-ring 119 which is also compressed between a skirt 118 of the sleeve bearing and nut 117 when the nuts 116 and 117 are tightened. These O-rings are conventionally of rubber or synthetic compressible material and provide just sufficient restraint on the rotation of the fork or yoke 29 about its shaft 109 to prevent the flutter that is often encountered in such devices.

Figure 15:
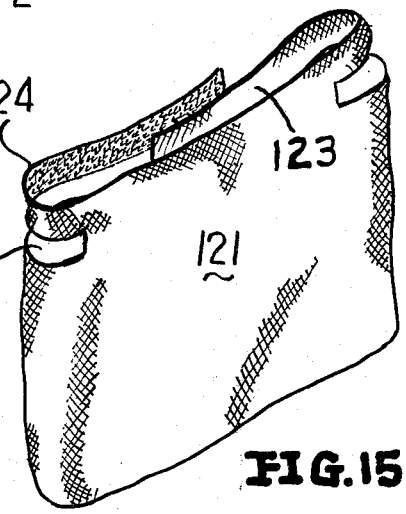
FIG. 15 is an illustration of the canvas back of the apparatus.

Referring now specifically to FIG. 15, there is illustrated canvas seat 121 having Velcro fasteners. Specifically, the canvas is folded around the side members 1 and 2 and overlapped so that the Velcro portion 122 on one surface engages a mating Velcro of the fastener on the other end portion 123 of the canvas seat. The seat is arranged so that an upper extension 124, as viewed in FIG. 15, which is really the back of the seat when it is in a flat condition, extends around the members 1 and 2 behind the post or hollow member 9 and corresponding post on the other side of the chair. This latter portion 124 may be made loser than the remainder of the body so that the back of the seat is lower than the front part; correspondingly, it may be made tighter than the remainder so that the front part of the seat is lower than the back and obviously it may be made of the same tightness about the members 1 and 2 to provide a level seat. This is important since, in basketball, it may be desirable to be more upright than in a racing type of device in which the racer may want to be deeper in the seat, i.e. lower at the back. Also, the seat may be made uniformly lower or higher and may readily accommodate different widths of the chair. Basically, the same arrangement is employed for the back of the chair again permitting great flexibility in distance between the front of the seat and its back and accommodation of different widths of the chair. The use of the Velcro, large areas of it in particular, permits a very strong canvas seat and back to be provided but ones which can be rapidly removed so that the device may be disassembled or new canvas put on or the seat and/or back removed to work on the device or what have you.

The sports wheel chair may be provided with standard handles such as 126 as viewed in FIG. 2. However, it may be that the handles that are desirable for someone to use when pushing should not be in such a high position when the device is being used for basketball or racing or other sport. For this reason among others, the handles are carried on a hollow tube 127 which telescopes within the tube 4 as viewed in FIGS. 2 and 14 and a button mechanism 128 of the type illustrated in FIG. 14 may be utilized to control positioning of the tube 127. Specifically, a button 128 of the mechanism can seat in any one of numerous holes 129 formed in the tube 4 to provide the vertical movement control.

An additional reason for the use of adjustable rear posts 127 is to permit the chair to adapt to different back heights. It is known that the greater the disability of the operator the higher the back must be to increase support. The adjustability of the posts 127 permits backs of different heights to be employed as desired or required by the operator.

As previously indicated, all of the various connections between hollow T-shaped members may be made by the use of epoxy cement except, however, the T-shaped member 8. It has been found that it is not possible to use epoxy at this location because of the tremendous lateral thrusts to which the device is subjected. Standard welding cannot be utilized because of the combination of the high strength steel and the very thin walls of the tube 1. In consequence, resort must be had to silver brazing. Due to the high cost of silver today and the labor intensity of such an operation, this approach is not desirable.

Referring now specifically to FIG. 16, an arrangement is provided which permits the elimination of the problem. The rear part of the side member 1 is shortened somewhat and the location of the T-member 8 is moved rearwardly so that the horizontal members of the T-shaped members 3 and 8 are abutting and are welded to one another. The tube 1 extends through the cross member of the member 8 and the leg 5 of the member 3 so that a long length of the tube 1 resides within these two members which are now basically a common member. Rotation of the sleeve 8 is now prevented due to the welding to the member 3 and the transverse support provided by the tubes 6 and 7. Thus, the member 1 may be epoxied to the members 3 and 8 without fear of the tube 9 being permitted to rotate. Due to this arrangement, many modifications can be made. Specifically, the T-member 8 may be removed as such and the leg 5 of the T-member 3 extended the requisite length to provide a tube provided in FIG. 16 by members 3 and 8 being welded together. The member 9 may then be welded to this extension of the member 3. This latter arrangement in modified form is employed in the structure of FIG. 17. The T-member 3 is not employed and instead an elongated leg 5' is welded directly to the tube 4 and the tube 9 could be welded to tube 5'. In the structure of FIG. 17, however, the wheel support arrangement has been altered. The tube 4 has a T-member 120 secured to its lower end; the T-member 120 having an elongated leg 125 extending toward the front of the chair to provide the rear wheel support. The T-members 3 and 120 in such an arrangement may be identical if desired except for the wheel mounting holes 130 and the surrounding ears as illustrated in FIG. 10.

As previously indicated, it is desirable in a basketball wheel chair to protect the spokes from the high impacts to which they would otherwise be subjected. Referring specifically to FIGS. 2, 3 and 18, a plastic shield 131 of tough thin flexible material such as polycarbonate, comprises a thin concave circular disc with a hollow opening 132 about the center thereof.

Rim 133 of the wheel 11, for instance, has disposed at regularly spaced intervals about its inner circumference, generally L-shaped clips 134 normally utilized to secure the hand wheels of the chair, for instance, a hand wheel 10 to the main wheel 11 via studs 136. In accordance with the present invention, base members 137 of the clips 134 are suitably secured to the rim 133 and the upright 138 of the L-shaped member is angled outwardly away from the center of the chair at a mating angle to the concavity of the shield 131.

Due to the flexibility of the shield 131, it may be readily installed behind the clips 134 and further retained in place by straps 139 secured to the shield and snapped around spokes of the wheel.

It can be seen that the wheel chair of the present invention provides a light weight, rugged, quickly assembled and diassembled and repaired chair for use in sports as well as normal every day use. In addition, brakes, arm rests, etc. may removably be added to the chair to adapt the chair to normal use.

Various modifications may be made in the structure to accommodate special conditions. For instance, some individuals require their knees to be raised when operating the chair. In such instances, the tube 13 is not angled downward so that the tube 21 lies essentially in the same horizontal plane as the tube part 16 thereby raising the foot plate 19. Also, in either arrangement, the foot plate 19 may be placed in front of tube 13 as well as behind so as to readily accommodate people of different heights. An anti-tip roller may be provided at the rear of the chair by depending a hollow tube downward from an adjacent frame member.

Once given the above disclosure, many other features, modifications and improvements will become apparent to the skilled artisan. Such other modifications, features and improvements are, therefore, considered a part of this invention, the scope of which is to be determined by the following claims.

What I claim is:

1. A wheel chair comprising:

two generally parallel, elongated main frame members extending along opposite sides of the chair from front to back, said members each comprising a continuous hollow tube having a generally horizontal region extending from adjacent the back of said chair and terminating in a downwardly depending region extending to the front of said chair, means permitting flexure of said main frame members under front end impact and torque loads, said means comprising the length and wall thickness of said hollow main frame members and the properties of the material thereof.

means for securing main wheels each to a different one of said main frame members adjacent the back to the wheel chair, means for securing small front wheels each to a different one of said main frame members adjacent the front of the wheel chair, and means for detachably connecting the main frame members one to the other.

2. The apparatus according to claim 1 wherein said means for detachably connecting said frame members includes:

a different hollow tube connected to each of said main frame members and extending toward the other frame member, and means for releasably securing said hollow tubes to one another.

3. The apparatus according to claim 2 wherein said means for releasably securing comprises a split hollow cylinder on an internal diameter and length to receive both said hollow tubes, and eccentric locking means for reducing the internal diameter of said cylinder to securely hold end sections of both said tubes.

4. The apparatus according to claim 2 wherein said means for detachably connecting includes:

parallel, generally horizontal cylindrical means extending generally parallel to and connected to said main frame members, adjacent their front ends, a rigid foot plate adapted to extend between said cylindrical members adjacent the front ends thereof, and means detachably securing said foot plate to each of said cylindrical members for limited rotational movement.

5. The apparatus according to claims 1 or 2 further comprises:

a seat comprising a length of material having extensive areas of fastening material applied to opposed surfaces adjacent opposite end regions of said length of material, said seat extending between, over and passing under said main frame members whereby said fastening material adjacent opposite end regions mate under the upper seat area, said fastening material comprising complementary gripping elements.

6. The apparatus according to claims 2 or 3 wherein each said main frame members define a plane, and means for permitting pivoting of said main frame members relative to one another about an axis perpendicular to said planes.

7. The apparatus according to claim 1 wherein said means for securing each of said front wheels comprises:

a hollow tube secured to the forward end of said main frame member, said hollow tube being angled inwardly from back to front of said chair, said hollow tube having front and back sections extending to the front and back respectively of the front end of said main frame member, and means mounting said front wheels on said back section of said hollow tube.

8. The apparatus according to claim 7 wherein said means for detachably connecting comprises a foot plate, and means securing said foot plate between said front sections of said hollow tube associated with each of said main frame members.

9. The apparatus according to claim 8 wherein said means for securing includes:

a further hollow tube secured to the front end of said front section of said hollow tube, said further hollow tube having a front region and a rear region extending forwardly and rearwardly of said hollow tube, and means securing said foot plate between said further hollow tube associated with each said hollow tube.

10. The apparatus according to claim 9 further comprising:

an elongated roller, and means for securing said elongated roller to said front region of each said further hollow tube below the level of said foot plate.

11. The apparatus according to claim 1 further comprising means for preventing flutter of said front wheels, said means comprising a sleeve, a bearing disposed in said sleeve, a shaft extending through said bearing, an O-ring disposed adjacent said bearing, and means for compressing said O-ring against said bearing to restrain rotation thereof.

12. A frame member for a wheel chair comprising:

a unitary hollow cylindrical main frame member of high strength material having an elongated straight first section terminating in a second section extending downwardly at an angle thereto, a generally T-shaped hollow member having a cross member and a leg member, said leg member being disposed about an end of said first section of said main frame member and secured thereto, means securing to said cross member a hollow tubular member at right angles to said leg member and said main frame member, and a further hollow tubular member secured to said main frame member between the end of said first section and said second section and extending parallel to said cross member.

13. The apparatus according to claim 12 wherein said leg member is secured to said main frame member by epoxy cement, and said further hollow member is secured to said leg member.

14. The apparatus according to claim 13 wherein said further hollow member includes a tubular cross member at one end thereof, said tubular cross member being secured to said main frame member by epoxy adhesive.

* * * * *